United States Patent [19]

Ashizaki et al.

[11] Patent Number: 4,701,677

[45] Date of Patent: Oct. 20, 1987

[54] COLOR CATHODE RAY TUBE APPARATUS

[75] Inventors: Shigeya Ashizaki, Takatsuki; Koichi Sugahara, Sakai; Hideo Muranishi, Osaka; Masao Natsuhara, Otsu, all of Japan

[73] Assignee: Matsushita Electronics Corporation, Kadoma, Japan

[21] Appl. No.: 760,247

[22] Filed: Jul. 29, 1985

[30] Foreign Application Priority Data

| | | | |
|---|---|---|---|
| Jul. 30, 1984 | [JP] | Japan | 59-159665 |
| Jul. 30, 1984 | [JP] | Japan | 59-159666 |
| Aug. 2, 1984 | [JP] | Japan | 59-163312 |
| Aug. 10, 1984 | [JP] | Japan | 59-168094 |

[51] Int. Cl.[4] ..... H01J 29/58

[52] U.S. Cl. ..... 315/382; 315/15; 313/414

[58] Field of Search ..... 315/14, 15, 368, 382, 315/16; 313/414, 449, 412

[56] References Cited

U.S. PATENT DOCUMENTS

| | | | |
|---|---|---|---|
| 3,544,836 | 12/1970 | Reisner | 315/382 |
| 3,702,950 | 11/1972 | Nakamura | 315/15 |
| 3,949,166 | 4/1976 | Fuse | 315/382 |
| 3,952,227 | 4/1976 | Van Alphen | 313/449 |
| 4,370,594 | 1/1983 | Kuzenetzoff | 313/414 |
| 4,443,736 | 4/1984 | Chen | 313/449 |
| 4,468,587 | 4/1984 | Sluyterman | 313/414 |
| 4,473,775 | 9/1984 | Hosokoshi et al. | 313/449 |

*Primary Examiner*—Theodore M. Blum

*Attorney, Agent, or Firm*—Cushman, Darby & Cushman

[57] ABSTRACT

In a cathode ray tube apparatus having an in-line type electron gun, the focusing grid of the quadrupole electric field (8) which comprises the horizontal-electric-field boosting grids (11) and (11') and the vertical-electric-field boosting grids (12) and (12') is disposed between the first focusing grid (7) and the second focusing grid (9).

10 Claims, 28 Drawing Figures

COLOR CATHODE RAY TUBE APPARATUS

BACKGROUND OF THE INVENTION

1. Field of the Invention:

The present invention relates to a color cathode ray tube apparatus which comprises an in-line type color cathode ray tube and an associated focusing means.

2. Description of the Prior Art:

In an in-line type cathode ray tube (hereinafter abbreviated as CRT) which comprises three electron beam outlets disposed on a horizontal straight line, using a saddle type or a toroidal type deflection yoke as a beam deflection means, the horizontal deflection magnetic field is distorted into a pincushion shape and the vertical deflection magnetic field is distorted into a barrel shape. As a result, the obtained self-convergence effect can sharply simplify the component of the focusing system.

On the contrary, as shown in FIG. 1, at the phosphor screen 1, especially the fringe parts of the phosphor screen, here the beam spot 2 which is distorted to be non-circular by the deflection induced beam distortion, therefore resolution is deteriorated. The beam spot 2 comprise a horizontally elliptical high luminance core portion 3 and its attendant low luminance haze portion 4. Such lowering of the resolution by the deflection induced beam distortion can be alleviated by applying a shorter distance between the main focus lens and the cathode of the electron gun to decrease the diameter of the electron beam passing through the main focus lens of the electron gun and the deflection field or only by decreasing the diameter of the electron beam with a stronger pre-focus lens. These measures increase the magnification of the lens system of the electron gun, and as the result the diameter of the beam spot around the centre part of the screen becomes undesirably large.

As shown in FIG. 2, the optimum focus voltage for the horizontal diameter of the beam spot is immutable at any point of the phosphor screen, while the optimum voltage for the diameter becomes higher as the spot goes to the fringe part of the phosphor screen (especially at E and NE in FIG. 1)

Accordingly, when driving at the optimum focus voltage (which is 6 KV in FIG. 2) for the horizontal diameter, the beam spot at the fringe part of the phosphor screen becomes over-focussed in the vertical direction and the above-mentioned vertical haze is produced resulting in the deterioration of the resolution.

As shown in FIG. 3, the resolution in the fringe parts of the phosphor screen can be enhanced without producing such vertical haze by sacrificing resolution at the center part of the phosphor screen through the lowering of the vertical focusing voltage than the horizontal optimum focusing voltage although resolution is lowered a little at the center part.

SUMMARY OF THE INVENTION

Accordingly, the purpose of the present invention is to provide an improved CRT apparatus, especially a color CRT apparatus, which has high resolution all-over the phosphor screen without the lowering of resolution at the centre part of the screen.

A color CRT apparatus in accordance with the present invention comprises, a first focusing grid to which a first focusing voltage is to be applied, a second focusing grid to which a second focusing voltage is to be applied, means for generating a quadrupole electric field between the first focusing grid and the second focusing grid which contains at least one of horizontal-electric-field boosting grid for the three electron beams disposed in a horizontal line and at least one grid to produce vertical electric-field boosting grid for the three electron beams, at least one of the horizontal-electric field boosting grid and the vertical-electric-field boosting grid being applied with a focusing voltage corresponding to the change in the deflection angle of the electron beams.

BRIEF DESCRIPTION OF THE DRAWINGS

FIG. 5(*b*) is a front view of a vertical-electric-field boosting grid plate of the embodiment in FIG. 4.

FIG. 17(*b*) is a schematic front view of still other preferred embodiment of the vertical focusing grid plate forming the quadrupole electricfield in accordance with the present invention.

DESCRIPTION OF THE PREFERRED EMBODIMENTS

A first preferred embodiment is described with reference to FIG. 4, FIG. 5(*a*), FIG. 5(*b*), FIG. 6(*a*), FIG. 6(*b*), FIG. 7(*a*), FIG. 7(*b*), FIG. 7(*c*) and FIG. 7(*d*).

Figure 4:
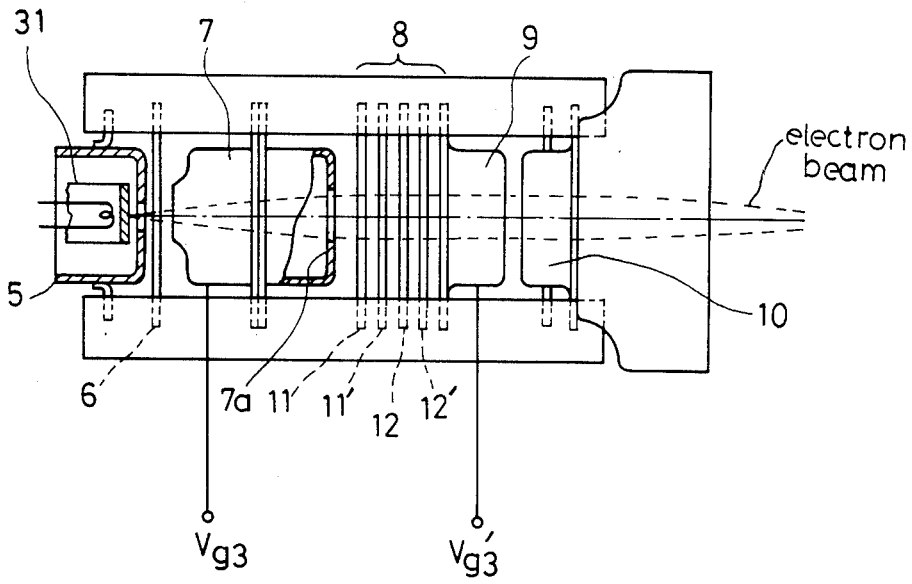
FIG. 4 is a sectional side view of a preferred embodiment of the electron gun in accordance with the present invention.

As shown in FIG. 4, the electron gun comprises a control grid 5, an accelerating grid 6, a first focusing grid 7, a focusing grid system 8 forming the quadrupole electric field 8, a second focusing grid 9 and an anode 10 disposed in the above-mentioned order from a position of a cathode 31 to a direction of an anode.

Figure 5:
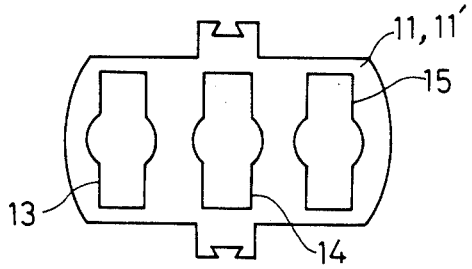
FIG. 5(*a*) is a front view of a horizontal-electric-field boosting grid plate of the embodiment in FIG. 4.
Figure 5:
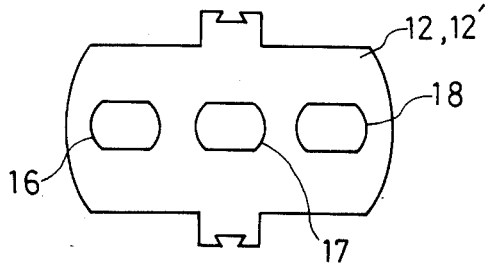

The focusing grid system 8 forming the quadrupole electric field 8 comprises a horizontal-electric field boosting grids 11 and 11' which have a front shape as shown in FIG. 5(*a*), and a vertical-electric-field boosting grids 12 and 12' which have a front shape as shown on FIG. 5(*b*).

Each of the horizontal-electric-field boosting grids 11 and 11' have three vertically oblong windows 13, 14 and 15 horizontally disposed and through which electron beams for R, G, B spots pass through, respectively. Each of the vertical-electric-field boosting grids 12 and 12' have horizontally disposed three horizontally oblong windows 16, 17 and 18 through which electron beams for R, G, B spots pass through, respectively.

The horizontal-electric-field boosting grids 11 and 11' are connected with the first focusing grid 7 in the tube, and applied with a first focus voltage $V_{g3}$. Also, the vertical electric-field boosting grids 12 and 12' are connected with the second focusing grid 9, and applird with a second focus voltage Vyhd g3'.

Figure 6:
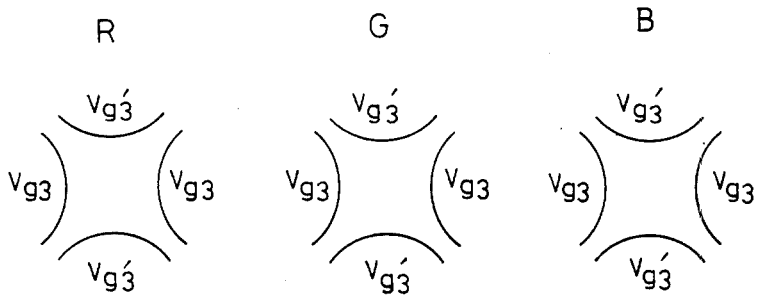
FIG. 6 is a schematic front view of the quadrupole electric field of the embodiment in FIG. 4.

Accordingly, as shown in FIG. 6, three quadrupole electric fields are formed between the horizontal -electric-field boosting grids 11 and 11' the vertical-electric field boosting grids 12 and 12'.

Setting the relation between the first and the second focusing voltage as $V_{g3} < V_{g3}'$, the quadrupole electric field is acting as a convergent lens in the horizontal direction, and as a divergent lens in the vertical direction. So, when the first focusing voltage $V_{g3}$ is kept constant and the second focusing voltage $V_{g3}'$ is gradually raised from $V_{g3}$ as the beam deflection angle increases, the quadrupole electric field is formed. The electron beam passing through the quadrupole electric field is subject to convergent lens action in the horizontal direction and divergent lens action in the vertical direction as the beam deflection angle increases.

On the other hand, since the high voltage applied ti in the anode 10 is constant, the beam focusing action of the main focus lens created between the second focusing grid 9 and the anode 10 is caused to be weaken by the increase in the beam deflection angle.

In accordance with the offset of the former and the latter actions, the electron beam through the quadrupole electric field and the main focus lens come to an optimum focus state with respect to the horizontal direction and the under focus with respect to the vertical direction.

As the result, irrespective of the above-mentioned particular vertical excessive focusing action given to the electron beam by the deflection lens action of the deflection magnetic field of the in line type deflection yoke, the beam spot at the phosphor screen gets nearly round and its diameter becomes small, iresspective whether in the center part or the fringe part of the screen.

Figure 7:
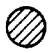
FIG. 7(*a*), FIG. 7(*b*), FIG. 7(*c*) and FIG. 7(*d*) are cross sectional views of the electron beams which are explaining the focusing modes of a CRT apparatus.
Figure 7:
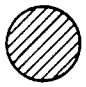
Figure 7:
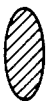
Figure 7:
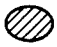

The following is the explanation of the action as above mentioned using FIG. 7(*a*) to FIG. 7(*d*).

FIG. 7(*a*) is a cross sectional view of the optimum focus electron beam with respect to the horizontal and vertical direction. Such electron beam is impinging on the center part of the phosphor screen.

FIG. 7(*b*) is a cross sectional view of the electron beam given the focusing lens action only by the main focus lens wherein the focusing lens action is us the deflection angle increases.

FIG. 7(*c*) is a cross sectional view of the electron beam affected by the action of the quadrupole electric field.

FIG. 7(*d*) is a cross sectional view of the electron beam at the fringe part of the phosphor screen which passed through the quadrupole electric field the main focus lens and the deflection electric field.

Instead of disposing the two horizontal-electric-field boosting grids 11 and 11' and two vertical-electric-field boosting grids 12 and 12' as the present embodiment, it is also preferable to dispose the grid 12 adjasent to the grid 11, the grid 11' adjacent to 12 and the grid 12' adjacent to 11', the connections of the grids 11 and 11' are to the first focusing grid 7, and of the grids 12 and 12' are to the second focusing grid 9 in the same manner as the previous embodiment. In this embodiment, both the horizontal and vertical-electric-field boosting grids comprises two grid plates. But such modification may be made that one of or both of the grids may comprise one or more than three grid plates. Still other modification may be to use the surface 7(*a*) of the first focusing grid 7 which faces the second focusing grid as the horizontal-electric-field boosting grid.

Figure 8:
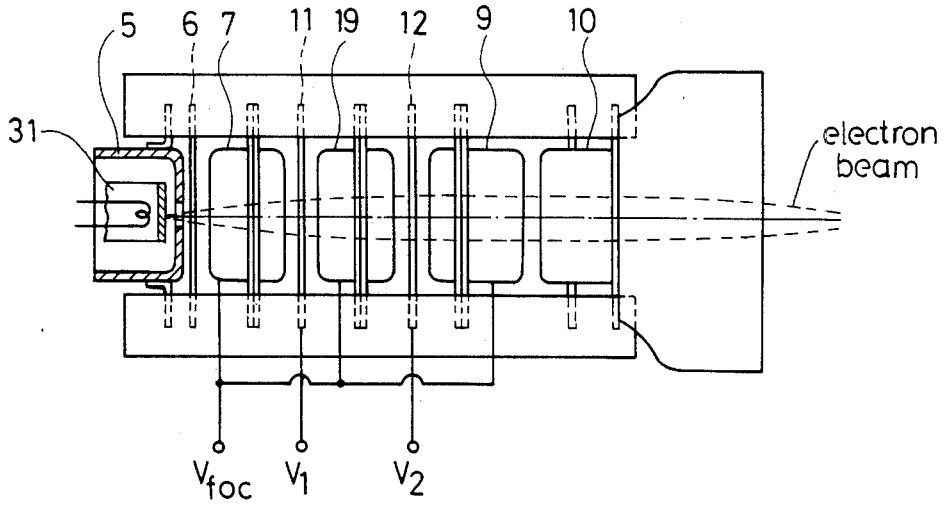
FIG. 8 is a sectional side view of another preferred embodiment of the electron gun in accordance with the present invention.

Another embodiment of the color CRT apparatus is configurated as shown in FIG. 8, wherein the third focusing grid 19 is disposed between the first focusing grid 7 and the second focusing grig 9, the horizontal-electric-field boosting grid 11 is disposed between the first focusing grid 7 and the third focusing grid 19 and the vertical-electric-field boosting grid 12 is disposed between the third focusing grid 19 and the second focusing grid 9.

The first, second and third focusing grids 7, 9 and 19 are connected in the tube and a focusing voltage $V_{foc}$ is applied to them, a voltage $V_1$ of several hundreds volt is applied to the horizontal-electric-field boosting grid and a voltage $V_2$ of several hundreds volt is applied to the vertical-electric-field boosting grid.

Holding the voltages $V_1$ and $V_2$ constant below the voltage $V_{foc}$, the first stage of the quadrupole electric field is produced near the electron beam window 13, 14 and 15 of the horizontal electric-field boosting grid 11, and the second stage of the quadrupole electric field is produced near the electron beam window 16, 17 and 18 of the vertical-electric-field boosting grid 12.

The electron beam passing through the first stage of the quadrupole electric field is subject to the convergent lens action in the horizontal direction and the divergent lens action in the vertical direction with respect to its cross-sectional shape. Also, the electron beam through the second stage of the quadrupole electric field is subject to the divergent lens action in the horizontal direction and the convergent lens action in the vertical direction with respect to its cross-sectional shape.

Accordingly, the lens actions by the first and second stage quadrupole electric field given on the electron beam passing through are complete offset, and consequently with respect to the lens action the quadrupole electric field is equivalent to the action of the conventional axially symmetrical multi stage lens field. The condition that the above mentioned offset action constitutes does not change during a process of rising the voltages of $V_1$ and $V_2$ to the voltage of $V_{foc}$. However, because both of the first and second stage of quadrupole electric fields are weak, the electron beam which impinges on the phosphor screen is under-focused in the horizontal and vertical direction with respect to its cross sectional shape.

In such under-focused state, when only the voltage of $V_1$ is lowered the first stage only of the quadrupole electric field is intensified, and the cross-sectional shape of the electron beam arriving at the phosphor screen is subject to the converging action in the horizontal direction and the diverging action in the vertical direction, and hence it becomes to the optimum focus state with respect to the horizontal direction, while the degree of the under-focus with respect to the vertical direction increases.

On the other hand, in a color CRT apparatus which is provided with a deflection yoke for in-line type color CRT, the degree of convergence of cross-sectional shape of the electron beam increases as the beam deflection angle increases, as mentioned as above. Accordingly, by gradually decreasing the voltage $V_1$ only from several hundred volts like the case of $V_2$, the cross sectional shape of the beam spot impinging on the phosphor screen can be made the optimum focus state both in horizontal and vertical directions. And, thus on all the area of the phosphor screen, beam spots of small size and substantially circular shape are obtainable. Furthermore, when the shape and the position of the vertical-electric-field boosting grid, which is attributable to generation of the second stage of the quadrupole electric field, is appropriately selected, similar functiones as above is obtainable by fixing the voltage of $V_1$ at a low level and raising the voltage $V_2$ from the low level as the beam deflection angle increases or by relatively changing the voltages $V_1$ and $V_2$.

Figure 9:
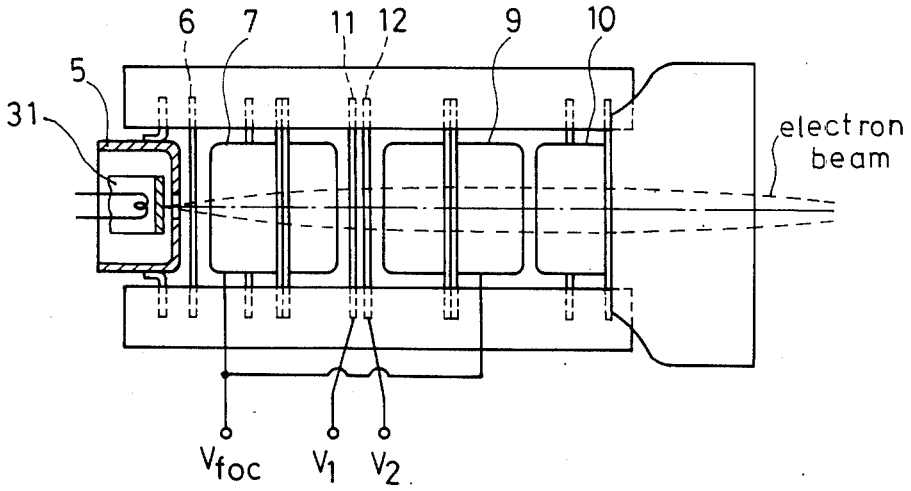
FIG. 9 is a sectional side view of still other preferred embodiment of an electron gun in accordance with the present invention.

Still another embodiment of the color CRT apparatus is configurated as shown by FIG. 9, wherein the horizontal and vertical-electric-field boosting grids 11 and 12 for generating the quadrupole electric field are disposed between the first focusing grid 7 and the second focusing grid 9, and the voltages $V_{foc}$, $V_1$ and $V_2$ are changed in the same manner as the above-mentioned embodiments. And the other parts, components and actions are also the same as the preceding embodiments.

Figure 10:
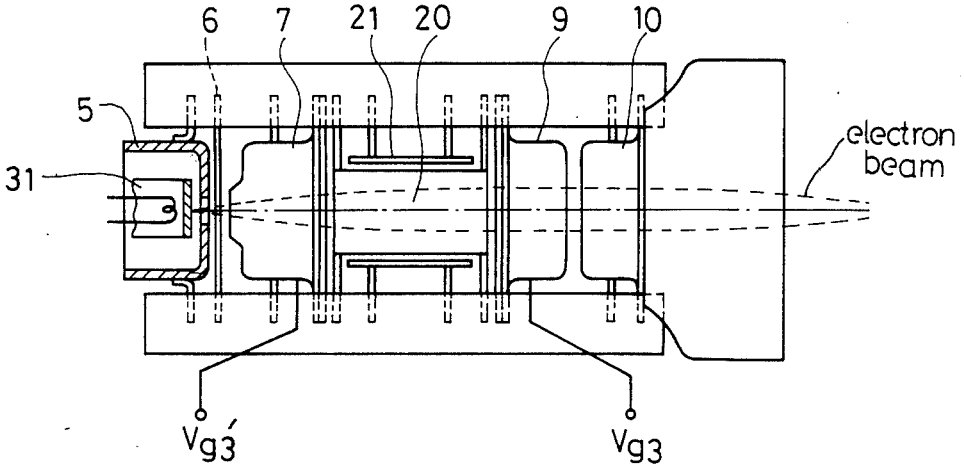
FIG. 10 is a sectional side view of still other preferred embodiment of an electron gun in accordance with the present invention.
Figure 11:
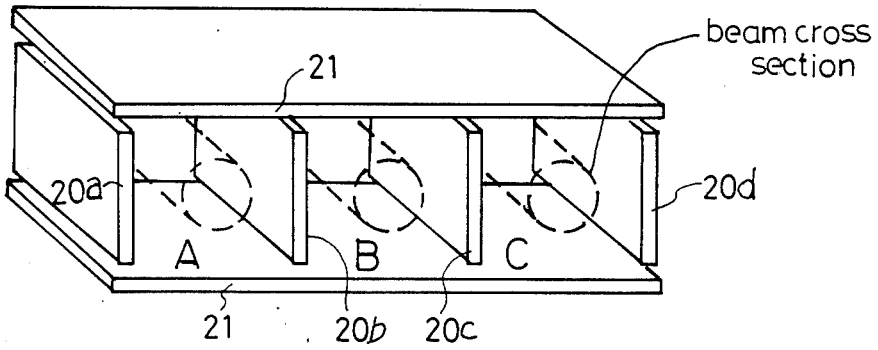
FIG. 11 is a schematic perspective view of the focusing grid system forming quadrupole electric field of the embodiment in FIG. 10.

Still other embodiment of the color CRT apparatus is configured as shown by FIG. 10 and FIG. 11, wherein the components of the focusing grids for making the quadrupole electric field is configured in a box type with four pieces of horizontal electric-field boosting grids 20a, 20b, 20c and 20d which are disposed in the vertical direction and two pieces of vertical electric-field boosting grids 21 which are disposed in the horizontal direction to form three spaces. Three electron beams pass through the three spaces A, B and C.

In the present embodiment, the four pieces of the horizontal electric field boosting grids 20 are connected with the first focusing grid 7 and the focusing voltage $V_{g3}'$ is applied thereto, and the two pieces of the vertical horizontal-electric-field boosting grids 21 are connected with the second focusing grid 9 to which the focusing voltage $V_{g3}$ is applied.

Accordingly, in the each space A, B and C, the quadrupole electric fields are created and the electron beams are subject to convergent or divergent lens action corresponding to the relation between the focusing voltages $V_{g3}$ and $V_{g3}'$ as shown in table 1.

TABLE 1

| | horizontal direction | vertical direction |
|---|---|---|
| $V_{g3} > V_{g3}'$ | convergence | divergence |
| $V_{g3} < V_{g3}'$ | divergence | convergence |

The electron beam converged and diverged by the quadrupole electric field is also subject to focusing lens action by the main focus lens formed between the second focusing grid 9 and anode 10, and impinging against the phosphor screen.

Figure 12:
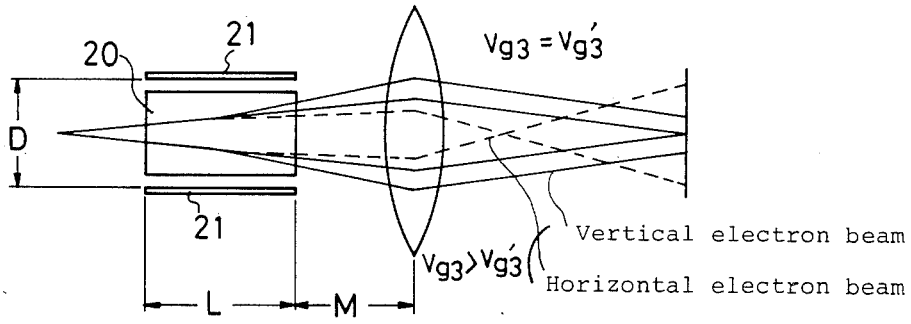
FIG. 12 is a schematic view of the paths of the electron beam through the quadrupole electricfield and main focus lens to the phosphor screen.

FIG. 12 shows a relation between the electron beam which are focused optimum in the absence of the quadrupole electric field $V_{g3}=V_{g3}'$ and the astigmatism on the beam spot in the presence of the quadrupole electric field ($V_{g3}>V_{g3}'$).

As the lens action the box type quadrupole electric field is relatively strong, it can sufficiently converge and diverge the electron beam even when the difference between the focus voltages $V_{g3}$ and $V_{g3}'$ is small. The degree of the astigmatism (the compensation sensitivity against the astigmatism in deflection magnetic field) is given by the quadrupole electric field lens power and the distance between the quadrupole electric field lens and the main focus lens. And when the distance L is long, or M or V are short in FIG. 12, the compensation scusitivity becomes higher.

Figure 2:
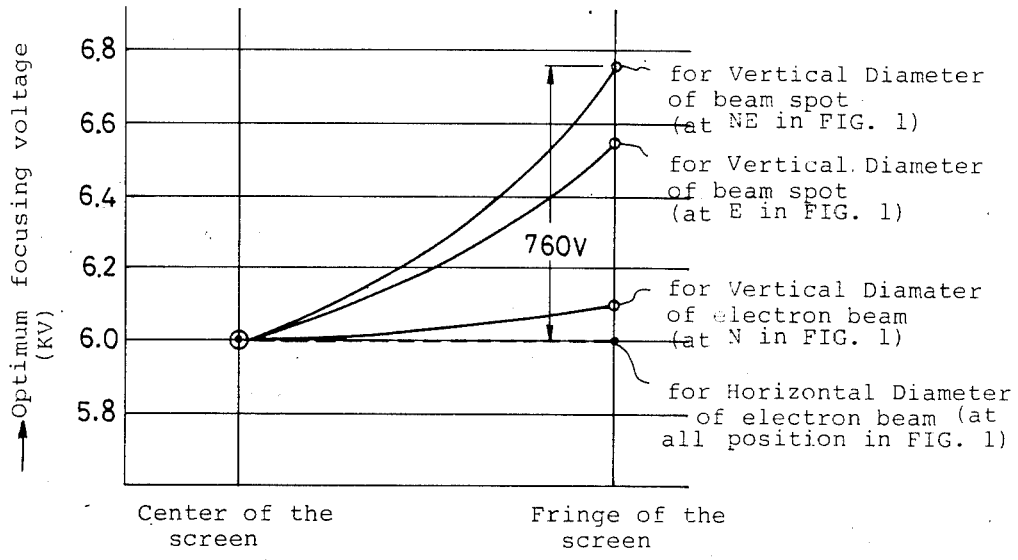
FIG. 2 (Prior Art)
FIG. 2 is the schematic characteristic curves showing the relation between the position of the beam spot and the optimum focus voltage.
Figure 3:
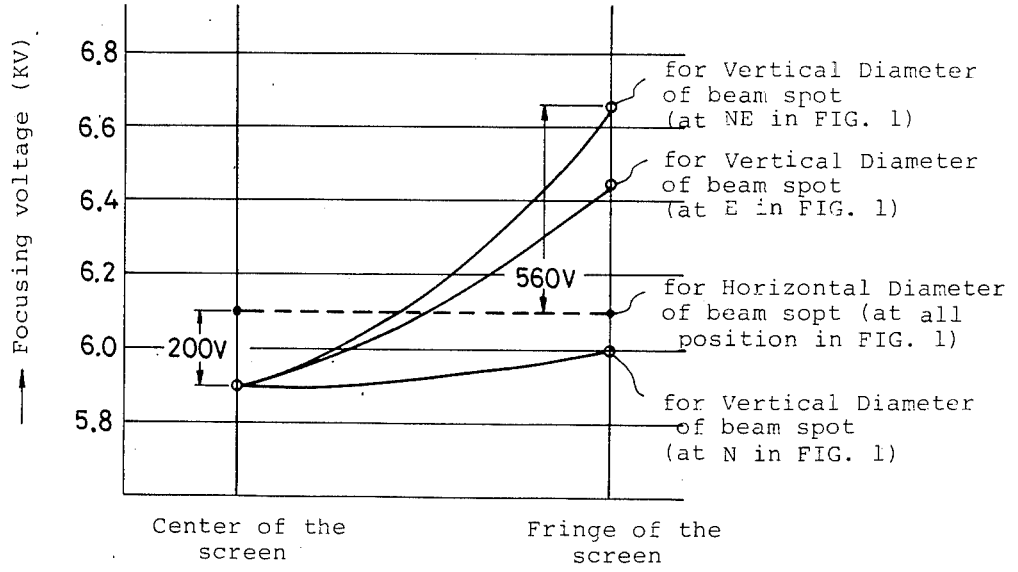
FIG. 3 (Prior Art)
FIG. 3 is the schematic characteristic curves showing the relation between the position of the beam spot and the focus voltage when the vertical focus voltage is set to be lower than the optimum focus voltage at the centre part of the screen.

By setting L=3.7 mm, D=5.0 mm, M=13 mm and the difference between the focusing voltages $V_{g3}$ and $V_{g3}'$ at 100 V, the astigmatism of the beam spot becomes about 280 V when expressed in the difference between the optimum focus voltages for the horizontal and vertical diameters shown in FIG. 2 and FIG. 3.

Thus the astigmatism in the beam spot can be changed freely and widely by setting only a small difference between the focusing voltages of $V_{g3}$ and $V_{g3}'$, and the astigmatism in the beam spot produced by the deflection-induced beam distortion can be offset. And also, the difference in the focusing voltage $V_{g3}$ for each of the three focusing parts (A,B,C) can compensate the spread of the astigmatism in the beam spot which is caused the irregularities of the electron beam windows of the second focusing grid 9 and the anode 10 forming the main focus lens.

Figure 13:
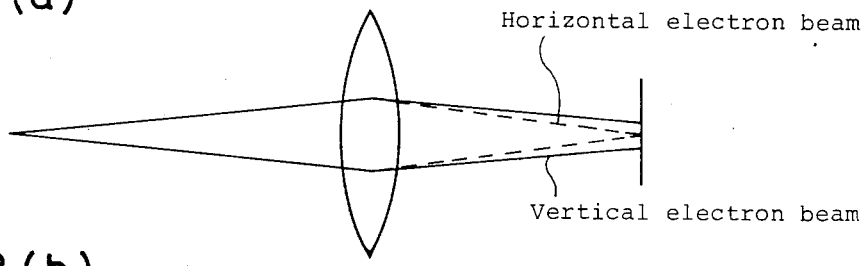
FIG. 13(*a*) and FIG. 13(*b*) are comparative schematic views showing modes of generation of an astigmatism in the beam spot and compensation thereof, respectively, both at the centre part of the phosphor screen.
Figure 13:
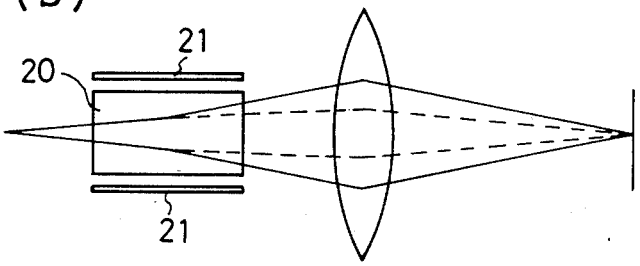

The electron beam impinging on the center part of the phosphor screen without the quadrupole electric field passes through a path shown in FIG. 13(*a*) and produces an astigmatism of about 200 V in the case of $V_{g3}=6$ KV when expressed in the focusing voltage difference as above mentioned. On the contrary, when the quadrupole electric field is provided, the electron beam passes through the ideal path shown in FIG. 13(*b*) under the condition of $V_{g3}=5.9$ V and $V_{g3}'=5.94$ KV. And also the electron beam impinging on the direction of NE in FIG. 1 of the phosphor screen passes through the path shown in FIG. 14(*a*) and produces the astigmatism of about 560 V in case of $V_{g3}=6$ KV under no existence of the quadrupole electric field. On the contrary, the electron beam passes through the ideal path shown in FIG. 14(*b*) in the case of $V_{g3}=6.25$ KV and $V_{g3}'=6.11$ KV under existence of the quadrupole electric field.

Figure 14:
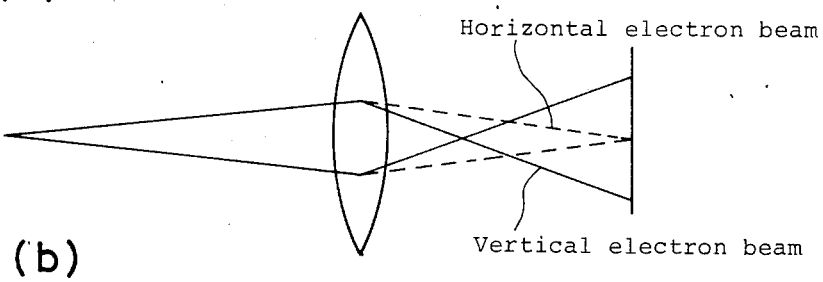
FIG. 14(*a*) and FIG. 14(*b*) are comparative schematic views showing modes of generation of an astigmatism in the beam spot and compensation thereof, respectively, both at the fringe part of the phosphor screen.
Figure 14:
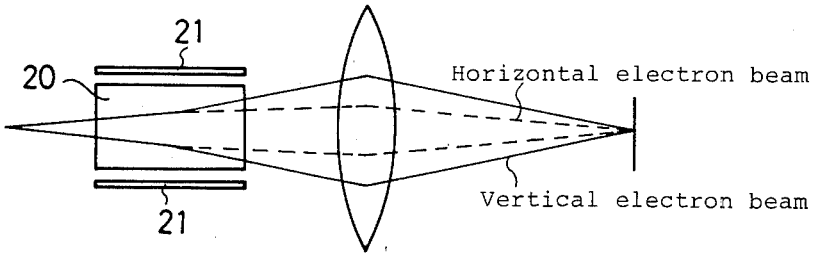

For simplisity's sake, in the illustration in FIG. 14(*a*) and FIG. 14(*b*), the degree of deflection of the electron beam is ignored.

In FIG. 13(*b*) and FIG. 14(*b*), to prevent the over-focus action in the horizontal direction which is shown by the broken line in FIG. 12, the power of the main focus lens is made weak and focusing of the electron beam is made in the horizontal direction.

That is, by raising the focusing voltage $V_{g3}$ as the deflection angle increases, the power of the main focus lens is weakened and the quadrupole electric fields is enhanced, and the electron beam is made in the optimum focus state in the horizontal and vertical direction. Thus, by changing both the focusing voltage $V_{g3}$ and $V_{g3}'$ to appropriate voltage corresponding to the deflection angle, the beam spot has the preferable focusing characteristic without the astigmatism on all-over the phosphor screen.

Figure 1:
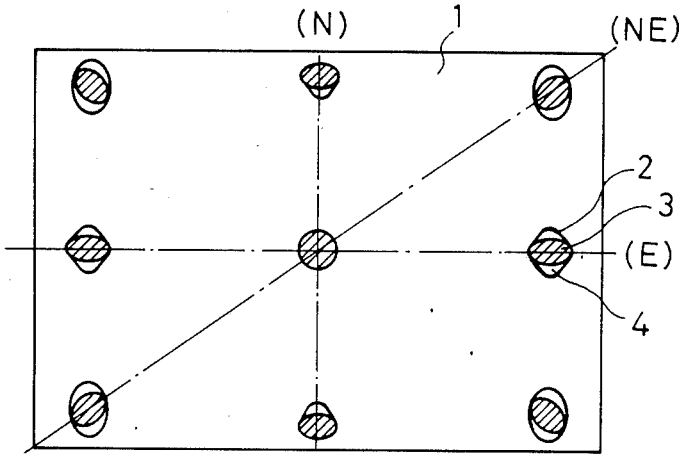
FIG. 1 (Prior Art)
FIG. 1 is the schematical front view of the phosphor screen of the conventional CRT apparatus schematically showing the shape of the distortions of the beam spots on various positions on the phosphor screen.

The astigmatism of the beam spot produced by the deflection induced beam distortion is large especially at the fringe part in the direction of E and NE of the phosphor screen in FIG. 1, and so, the desirable characteristic is obtainable only by superposing the dynamic compensation voltage which changes in synchronism with only the horizontal deflection upon the focusing voltage.

Figure 15:
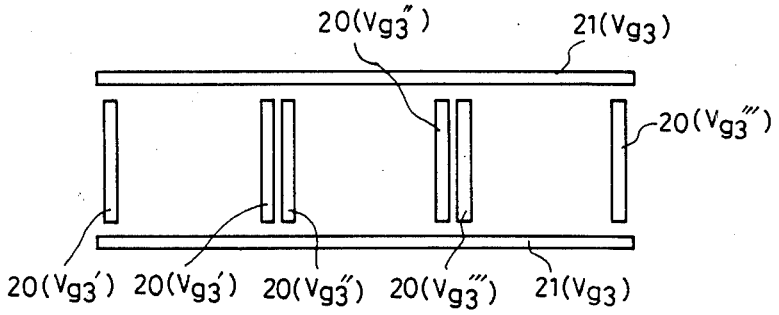
FIG. 15 is a schematic front view of still other preferred embodiment of the focusing grid system forming the quadrupole electric field in accordance with the present invention.
Figure 16:
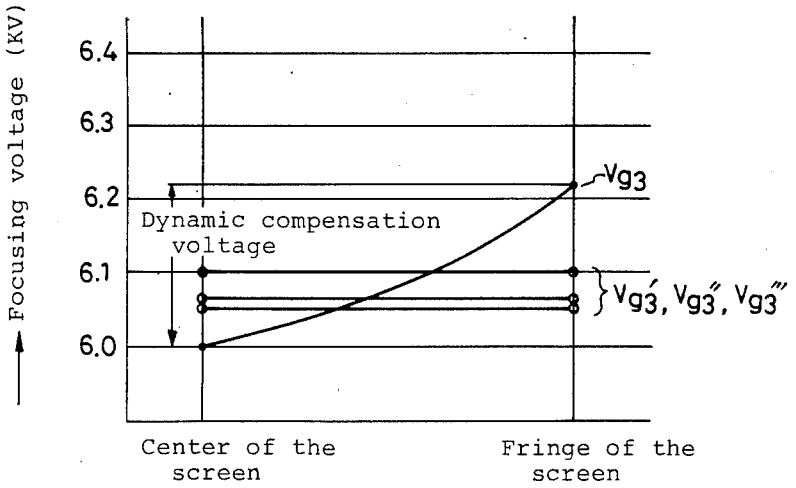
FIG. 16 is a schematic characteristic curve showing the relation between the position of the beam spot of the same diameter and the focus voltage of the embodiment in FIG. 15.

Still another embodiment of the color CRT apparatus is configurated as shown in FIG. 15 and FIG. 16, wherein the six pieces of the horizontal-electric-field boosting grids 20 and two pieces of the vertical horizontal-electric-field boosting grids 21 are disposed to controle the three quadrupole electric fields individually, and fixed focus voltages $V_{g3}'$, $V_{g3}''$ and $V_{g3}'''$ are applied to the former individually and a dynamic compensation focusing voltage $V_{g3}$ are applied to the latter.

Figure 17A:
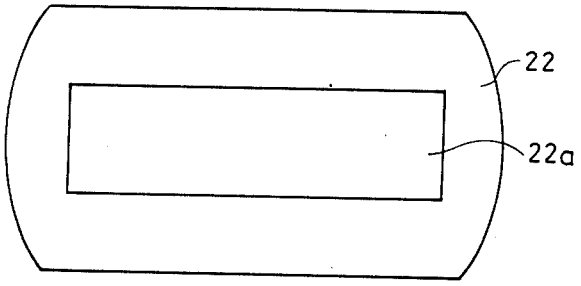
FIG. 17(*a*) is a schematic front view of still other preferred embodiment of the horizontal focusing grid plate forming the quadrupole electricfield in accordance with the present invention.
Figure 17B:
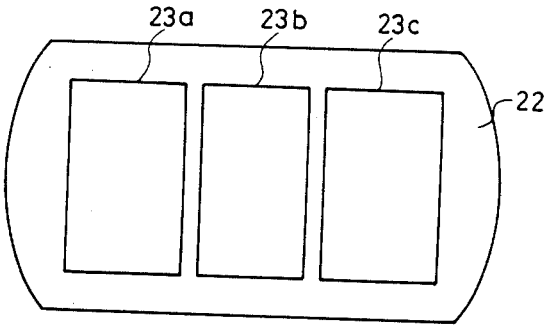
Figure 18:
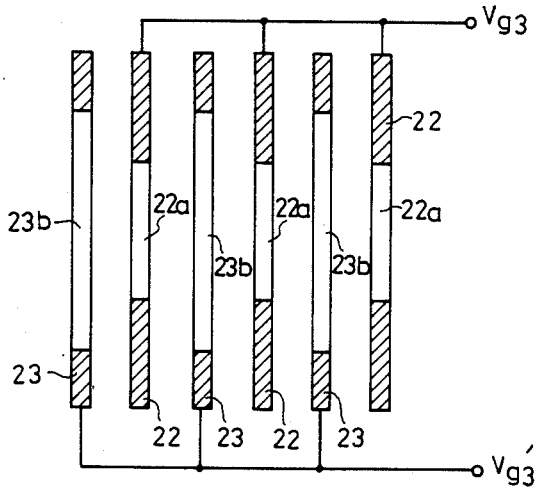
FIG. 18 is an enlarged cross sectional side view of a part of the embodiment in FIG. 17.

Still another embodiment of the color CRT apparatus is configured as shown in FIG. 17(*a*), FIG. 17(*b*) and FIG. 18, wherein several vertical -electric-field boosting grid plates 22 each having a stumpy rectangular window 22*a* and several vertical-/horizontal-electric-field boosting grid plates 23 having three lanky rectangular windows 23*a*, 23*b* and 23*c* are disposed alternately. By such configuration the grids can be constructed with high precision. In the present embodiment, the horizontal-electric-field boosting grid 20 or 23 are connected with the second focusing grid 9, and the vertical-electric-field boosting grid 21 or 22 are connected with the first focusing grid 7.

As a modificatio, the application of the focusing voltage $V_{g3}$ may be made to the horizontal-electric-field boosting grid connected with the first and second focusing grids 7 and 9 which are commonly connected, and the application of the focusing voltage $V_{g3}'$ may be made to the vertical-electric-field boosting grid, with the same electrode configuration.

When the compensation sensitivity of the astigmatism is unreasonably high, undue stability of the focusing voltages $V_{g3}$ and $V_{g3}'$ is necessitated but on the contrary, when the compensation sensitivity is unreasonably low, required dynamic compensation voltage becomes too high thereby resulting in a high load on the focusing circuit. Therefore, when the distance between the first focusing grid 7 and the second focusing grid 9 is taken as 100%, the length of the grid for the box type quadrupole electric field is preferably to be selected as 5 to 50%.

Figure 19:
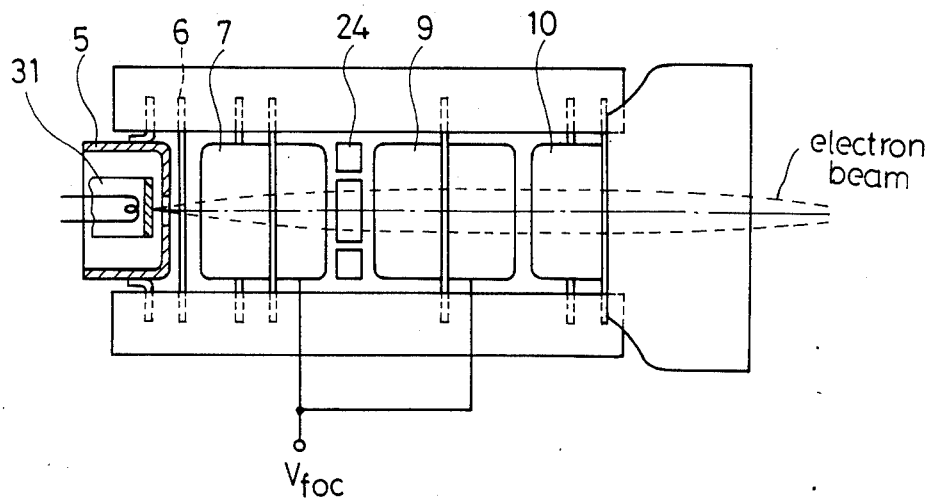
FIG. 19 is a sectional view of still other embodiment of the electron gun in accordance with the present invention.
Figure 20:
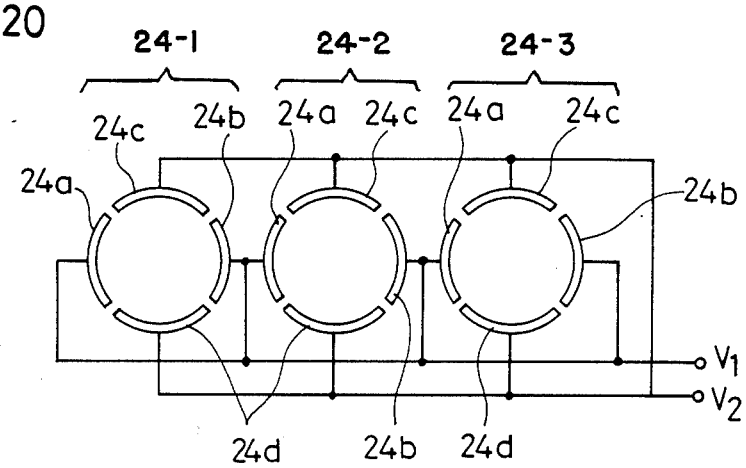
FIG. 20 is a schematic front view of the embodiment of the focusing grid system of forming the quadrupole electric field in FIG. 19.

Still another embodiment of the color CRT apparatus is configurated as shown in FIG. 19 and FIG. 20, wherein the grids of the quadrupole electric field 24 comprises three parts 24-1, 24-2, and 24-3, which are constituted with a pair of semi-cylindrical horizontal-electric-field boosting grids 24*a* and 24*b*, and a pair of semi-cylindrical vertical-electric-field boosting grids 24*c* and 24*d*. And each parts are enclosing the path of the electron beams between the first and the second focusing grids 7 and 9. The first and the second focusing grids 7 and 9 are commonly connected in the tube and the fixed focusing voltage $V_{foc}$ is applied thereto. Also a pair of horizontal-electric-field boosting grids 24*a* and 24*b* are applied with the voltage $V_1$ below several hundreds of volt and a pair of vertical-electric-field boosting grids 24*c* and 24*d* are applied with the voltage of $V_2$ below several hundreds of volt.

Accordingly, three quadrupole electric fields are produced between the first and the second focusing grids 7 and 9, and the main focus lens is formed between the second focusing grid 9 and the anode 10. Said quadrupole electric fields are produced under the condition that the voltage $V_1$ is not equal to the voltage $V_2$. Providing that the electron beam passing through the quadrupole electric field and the main focus lens and impinging against the centre part of the phosphor screen is set up to be the optimum focus in the horizontal and vertical directions. Then, by raising $V_1$ and $V_2$ with constant ratio therebetween, the electron beam becomes the under-focus state. By reducing only the voltage $V_1$ from this state, the quadrupole electric field is changed and the electron beams receive the convergent lens action in the horizontal direction and the divergent lens action in the vertical direction. And when the convergent lens action in the horizontal direction offsets the under-focus state, the electron beam is in the optimum focus state in the horizontal direction. Namely, by raising only the voltage of $V_2$ from its initial state, the electron beam is transferred to the under-focus state in the vertical direction with holding the optimum focus state in the horizontal direction.

As mentioned above, by raising only the voltage $V_2$ accompanied with the increase in the electron beam deflection angle, the electron beam which passes through the quadrupole electric field and the main focus lens and impinges on the fringe part of the phosphor screen (especially the direction of E and NE in FIG. 1) becomes the under-focus state with respect to its cross sectional shape. On the other hand, the electron beam passing through the deflection field increases the convergency in the vertical direction as the deflection angle increases as a result of the particular characteristic of the deflection yoke of the in-line type color CRT. Accordingly by the offseting of the former and the latter effects, the electron beams impinging on the phosphor screen including the fringe part thereof can be made in the optimum focus state in both the horizontal and vertical directions, and thus it is possible to obtain the small diameter and substantially circular beam spot.

Figure 21:
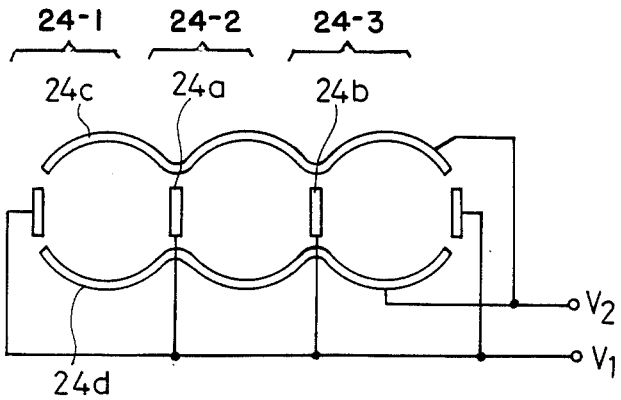
FIG. 21 is a schematic front view of still other preferred embodiment of the focusing grid forming the quadrupole electricfield in accordance with the present invention.

Yet another embodiment is configurated as shown in FIG. 21 wherein instead of using three pairs of the grids for the grids in the horizontal direction, only one pair of the grid can be used.

What is claimed is:

1. A color cathode ray tube apparatus which uses three electron beams, comprising:

a first focusing grid to which a first focusing voltage is to be applied;

a second focusing grid to which a second focusing voltage is to be applied;

means for generating a quadrupole electric field between said first focusing grid and said second focusing grid, said generating means including at least one horizontal-electric-field boosting grid connected with said first focusing grid for said three electron beams and at least one vertical-electric-field boosting grid connected with said second focusing grid for said three electron beams;

wherein at least one of said horizontal-electric-field boosting grid and said vertical-electric-field boosting grid are applied with a focusing voltage which varies responding to the change in the deflection angle of the electron beams.

2. A color cathode ray tube apparatus in accordance with claim 1, wherein said horizontal-electric-field boosting grid has at least one plate grid having three vertically oblong windows which the electron beam passes through, and said vertical-electric-field boosting grid has at least one plate grid having three horizontally oblong windows which the electron beam passes through.

3. A color cathode ray tube apparatus in accordance with claim 1, further comprising a third focusing grid, to which a same voltage as that applied to said first and said second focusing grids is applied, disposed between said horizontal-electric-field boosting grid and said vertical-electric-field boosting grid.

4. A color cathode ray tube apparatus in accordance with claim 1, wherein said horizontal-electric-field boosting grid comprises four vertically disposed plates connected with said first focusing grid, and said vertical-electric-field boosting grid comprises two horizontally disposed plates connected with said second focusing grid.

5. A color cathode ray tube apparatus in accordance with claim 1, wherein said horizontal-electric-field hoosting grid and said vertical-electric-field boosting grid respectively comprise three semi-cylindrical plate

6. A color cathode ray tube apparatus in accordance with claim 1, wherein a surface of said first focusing grid which faces said second focusing grid is used as said horizontal-electric-field boosting grid.

7. A color cathode ray tube apparatus which uses three electron beams, comprising:

a first focusing grid to which a first focusing voltage is to be applied;

a second focusing grid to which a second focusing voltage is to be applied;

means for generating a quadrupole electric field between said first focusing grid and said second focusing grid, said generating means including at least one horizontal-electric-field boosting grid for said three electron beams and at least one vertical-electric-field boosting grid for said three electron beams;

a third focusing grid to which a focusing voltage is applied, said focusing voltage being a same voltage level as that applied to one of said first and said second focusing grids, said third focusing grid disposed between said horizontal-electric-field boosting grid and said vertical-electric-field boosting grid;

wherein at least one of said horizontal-electric-field boosting grid and said vertical-electric-field boosting grid are applied with a focusing voltage which varies responding to the change in the deflection angle of the electron beams.

8. A color cathode ray tube apparatus in accordance with claim 7, wherein said horizontal-electric-field boosting grid has at least one plate grid formed with three vertically oblong windows through which the electron beam passes, and said vertical-electric-field boosting grid has at least one plate grid formed with three horizontally oblong windows through which the electron beam passes.

9. A color cathode ray tube apparatus which uses three electron beams, comprising:

a first focusing grid to which a first focusing voltage is to be applied;

a second focusing grid to which a second focusing voltage is to be applied;

means for generating a quadrupole electric field between said first focusing grid and said second focusing grid, said generating means including at least one horizontal-electric-field boosting grid connected with said first focusing grid for said three electron beams and at least one vertical-electric-field boosting grid connected with said second focusing grid for said three electron beams;

a third focusing grid to which a focusing voltage is applied, said focusing voltage being a same voltage level as that applied to one of said first or said second focusing grids, said third focusing grid disposed between said horizontal-electric-field boosting grid and said vertical-electric-field boosting grid;

wherein at least one of said horizontal-electric-field boosting grid and said vertical-electric-field boosting grid are applied with a focusing voltage which varies responding to the change in the deflection angle of the electron beam.

10. A color cathode ray tube apparatus in accordance with claim 9, wherein:

said horizontal-electric-field boosting grid has at least one plate grid formed with three vertically oblong windows through which the electron beam passes, and said vertical-electric-field boosting grid has at least one plate grid formed with three horizontally oblong windows through which the electron beam passes.

* * * * *